US006705086B1

(12) United States Patent
Retzlaff et al.

(10) Patent No.: US 6,705,086 B1
(45) Date of Patent: Mar. 16, 2004

(54) ACTIVE THRUST CONTROL SYSTEM FOR COMBINED CYCLE STEAM TURBINES WITH LARGE STEAM EXTRACTION

(75) Inventors: Klaus Manfred Retzlaff, Schenectady, NY (US); Samuel Gregory Clifford, Ballston Spa, NY (US); David William Hicks, Saratoga Springs, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/310,858

(22) Filed: Dec. 6, 2002

(51) Int. Cl.[7] ..... F01K 7/34
(52) U.S. Cl. ..... 60/653; 60/679
(58) Field of Search ..... 60/653, 677, 679; 415/104, 105, 106, 107

(56) References Cited

U.S. PATENT DOCUMENTS 3,604,206 A * 9/1971 Baily ..... 60/644.1
3,614,255 A * 10/1971 Rooney ..... 415/100
5,361,585 A * 11/1994 Westphal et al. ..... 60/646
5,784,888 A * 7/1998 Termuehlen ..... 60/677
6,134,891 A * 10/2000 Zaviska et al. ..... 60/648
6,443,690 B1 * 9/2002 Zabrecky et al. ..... 415/29

* cited by examiner

*Primary Examiner*—Hoang Nguyen
(74) *Attorney, Agent, or Firm*—Nixon & Vanderhye PC

(57) ABSTRACT

A combined cycle steam turbine including a system for providing process extraction steam includes a control system for counteracting the thrust effect of the steam extraction flow at the exhaust of the high pressure section of the steam turbine. The control system includes a valve and piping arrangement for diverting HP exhaust packing leak-off steam from a lower pressure stage to a higher pressure stage of an intermediate pressure section of the steam turbine.

18 Claims, 2 Drawing Sheets

ACTIVE THRUST CONTROL SYSTEM FOR COMBINED CYCLE STEAM TURBINES WITH LARGE STEAM EXTRACTION

BACKGROUND AND FIELD OF THE INVENTION

The invention is directed to a system for controlling axial steam turbine thrust to improve overall performance and reliability of a steam turbine.

Conventional steam turbines solve the large change in thrust load by increasing the thrust bearing area and avoiding a thrust load direction change from the active thrust bearing to the inactive thrust bearing.

SUMMARY OF THE INVENTION

The invention controls the axial steam turbine thrust by counteracting the thrust effect of a large steam extraction flow at the exhaust of the high pressure (HP) section.

Typically, the purpose of the extraction flow is:

a) to provide for steam injection into the gas turbine combustion system to augment the power output of the gas turbine, or b) to provide for process extraction steam.

The active thrust control is achieved by a pipe and valve arrangement that controls the pressure at a packing step when the steam is extracted from the HP exhaust, thereby counteracting the increased stage thrust by an equivalent but opposing increased step thrust. This results in an overall reduced thrust load range and permits the use of smaller thrust bearings with reduced mechanical losses.

The proposed thrust control system solves two problems. First, the inventive thrust control system reduces the range of the thrust bearing load for a combined cycle machine that is designed for large extraction flows from the high pressure (HP) exhaust. With reduced thrust load range, the thrust bearing size and mechanical losses can be reduced, resulting in an overall improved machine efficiency.

Second, the inventive thrust control system avoids the condition of zero or indeterminate thrust load and decreases the risk of unstable thrust bearing operation and its potential impact on thrust bearing reliability.

The invention improves the overall performance and reliability of a combined cycle steam turbine by controlling the thrust load to a smaller range.

DETAILED DESCRIPTION OF THE INVENTION

Figure 1:
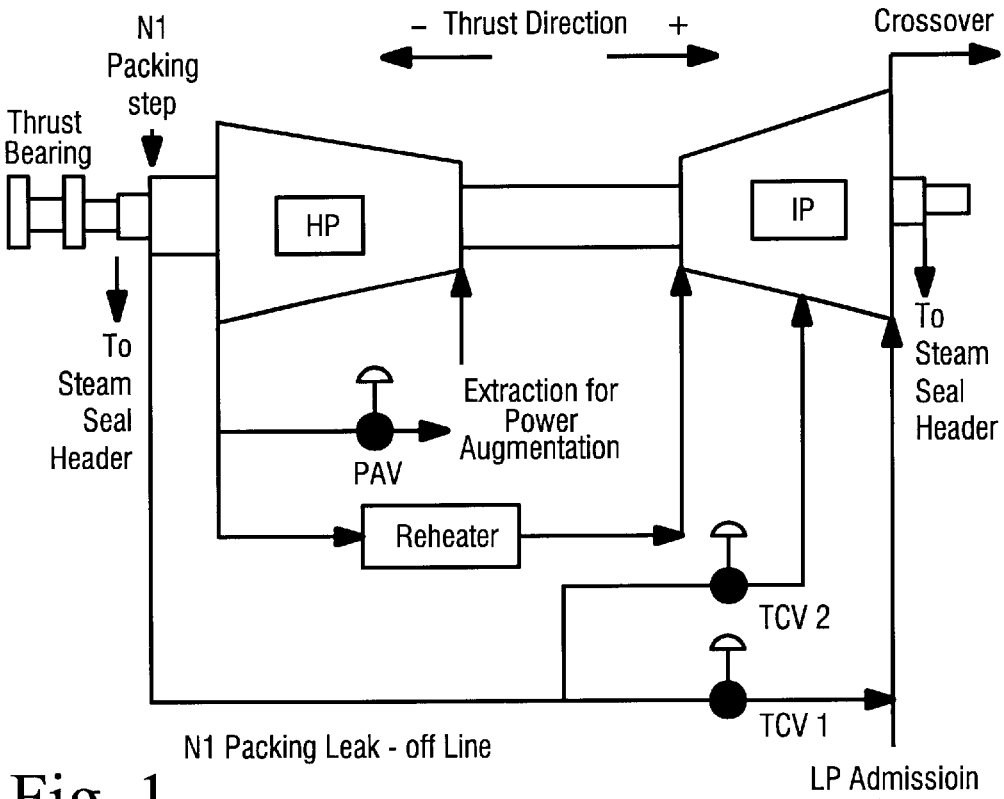
FIG. 1 illustrates in schematic form a thrust control system according to a first embodiment of the invention.
Figure 2:
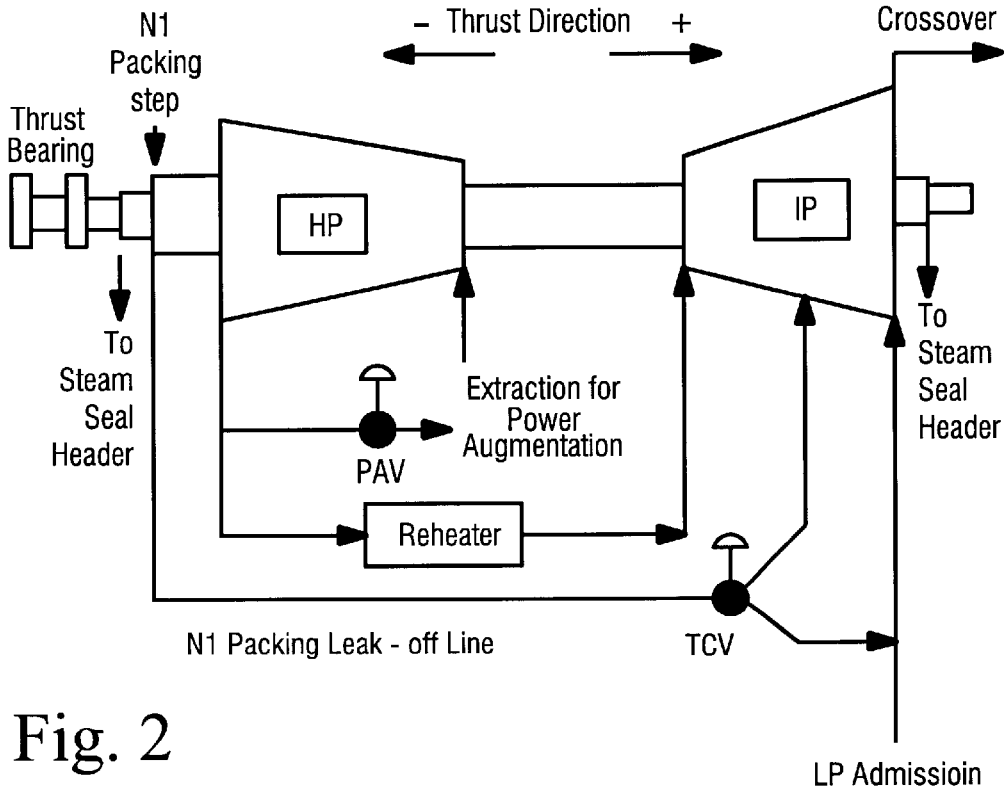
FIG. 2 illustrates in schematic form a thrust control system according to a second embodiment of the invention.

FIGS. 1 and 2 show combined cycle steam turbines having single flow high pressure (HP) and intermediate pressure (IP) sections. The exhaust from the IP section flows to the low pressure (LP) section (not shown on FIG. 1) via a crossover pipe. A reheater 18 provides reheated steam exhausted from the HP section to the IP section. The system also provides for HP exhaust extraction steam flow to be used for other equipment such as a gas turbine or a process system.

As shown in FIG. 1, the thrust control system consists of pipes 10 and valves 12, 14 that are activated by a control signal to divert the N1 packing leak-off pipe destination from a lower pressure stage to a higher pressure stage of the intermediate pressure (IP) section when the HP exhaust extraction flow is turned on via valve 16.

The invention has several elements that when combined result in the reduced thrust load range. For example, the rotor has to be designed with a larger step at the N1 leak-off point that generates a step thrust opposite to the direction of the HP stage thrust.

The N1 leak-off has to be connected to two different points in the downstream steampath: (1) to the IP exhaust (existing connection); and (2) to a stage with higher pressure upstream of the IP exhaust point (new connection). The second connection requires a new shell penetration between the hot reheat bowl and the IP exhaust.

The two new motor operated valves 12, 14 (thrust control valves TCV1 and TCV2) are provided for redirecting the N1 packing leak-off flow from the IP exhaust point A to the new higher pressure point B.

Figure 3:
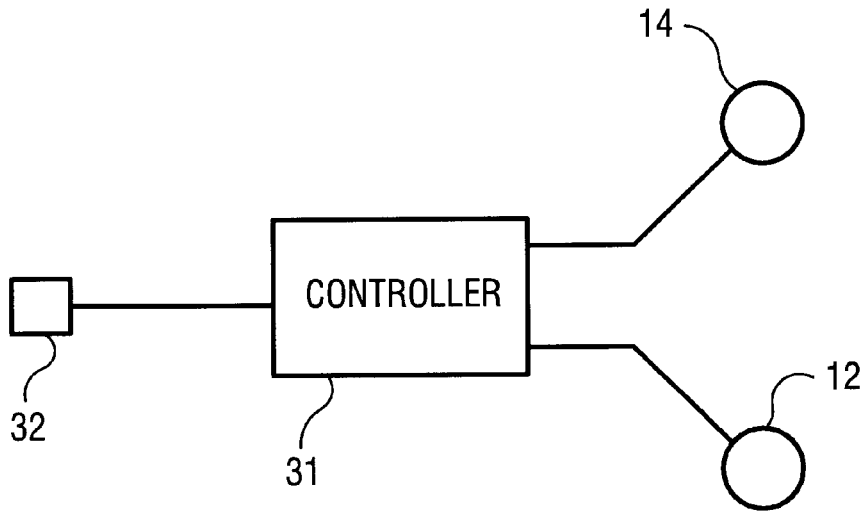
FIG. 3 shows in schematic form the control circuit for controlling the valves in the thrust control system.
Figure 4:
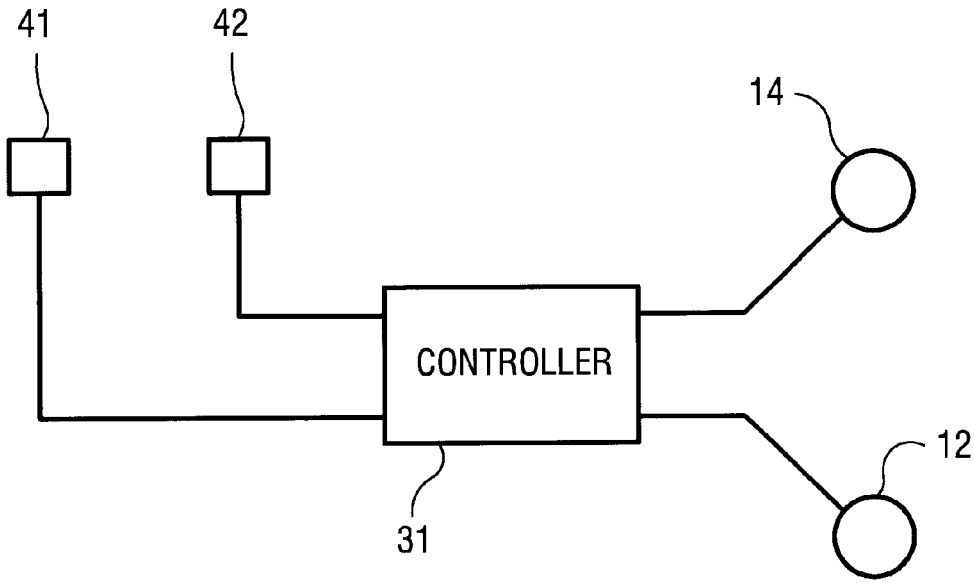
FIG. 4 shows in schematic form an alternative control circuit for controlling the valves in the thrust control system.

As shown in FIG. 3, a control system includes a controller 31 for sending a control signal to simultaneously operate valves 12, 14 based on a power control signal that activates valve 16 of the HP exhaust extraction flow, for instance a signal that controls the extraction flow for steam injection into a gas turbine combustion system (also referred to as "power augmentation"). The activation of valve 16 can be sensed and input to controller 31, for example, by sensor 32. Alternately, as shown in FIG. 4, the controller 31 can output the control signals to valves 12 and 14 in accordance with a preset pressure ratio of HP bowl pressure, sensed at point C by sensor 42 over HP exhaust pressure, sensed at point D by sensor 41.

The operation of the inventive system will now be described with reference to FIG. 1. When the HP exhaust extraction is turned on via opening valve 16, the HP exhaust pressure decreases and the pressure ratio across the HP stages increases. At the same time the HP stage thrust increases and the steam turbine net thrust shifts towards the HP exhaust flow direction.

The thrust control system is activated as described above to counteract the increased stage thrust. The valve 12 closes while the valve 14 opens thereby redirecting the N1 packing leak-off destination point to the higher pressure stage. This increases the step pressure at the N1 Packing rotor step and as a result, the step thrust magnitude increases. This then directly counteracts the increased stage thrust and works towards limiting the range of total thrust load variation over the whole operating envelope.

The implementation of this control system requires a judicious selection of the N1 packing rotor step diameter and the stage pressure for the second N1 packing leak-off connection. When the demand for HP exhaust extraction steam is terminated, the valve 12 opens and the valve 14 closes.

As shown in FIG. 2, an alternate embodiment uses a two way diverting valve (TCV) 21 that combines the functions of valves TCV1 and TCV2 shown in FIG. 1.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A steam turbine system having a single flow high pressure and opposing single flow intermediate pressure sections, a first steam path from a packing step at the exhaust of the high pressure section to the intermediate pressure section exhaust, and a process extraction system for extracting steam from the exhaust of the high pressure section, said system comprising:

piping for selectively connecting the packing step to a second steam path connected to a higher pressure stage, upstream of the intermediate pressure exhaust; and a valve control system disposed within said first and second steam paths for diverting the steam path from the intermediate pressure section exhaust to said higher pressure stage in response to a control signal.

2. A steam turbine system as claimed in claim 1, said valve control system comprises a first control valve disposed within said first steam path and a second control valve disposed within said second steam path.

3. A steam turbine system as claimed in claim 2, said valve control system further comprising control means for simultaneously closing said first control valve and opening said second control valve when the process extraction system extracts steam from the exhaust of the high pressure section.

4. A steam turbine system as claimed in claim 3, said control means determining when the process extraction system extracts steam from the exhaust of the high pressure section by sensing if a process extraction system control valve is opened.

5. A steam turbine system as claimed in claim 3, said control means determining when the process extraction system extracts steam from the exhaust of the high pressure section by determining that the steam pressure ratio at the inlet and exhaust of the high pressure section exceeds a predetermined number.

6. A steam turbine system as claimed in claim 1, said valve control system comprises a two-way diversion control valve disposed within said first and second steam paths.

7. A steam turbine system as claimed in claim 6, said valve control system further comprising control means for operating said two-way diversion control valve so as to close said first steam path and open said second steam path when the process extraction system extracts steam from the exhaust of the high pressure section.

8. A steam turbine system as claimed in claim 7, said control means determining when the process extraction system extracts steam from the exhaust of the high pressure section by sensing if the process extraction system control valve is opened.

9. A steam turbine system as claimed in claim 7, said control means determining when the process extraction system extracts steam from the exhaust of the high pressure section by determining that the steam pressure ratio at the inlet and exhaust of the high pressure section exceeds a predetermined number.

10. A method for counteracting the thrust effect of a large steam extraction flow at the exhaust of the high pressure section of a steam turbine system, said system also having at least an intermediate pressure section and a first steam path from a packing step at the exhaust of the high pressure system to the intermediate pressure section exhaust, said method comprising:

providing a second steam path from the packing step to a higher pressure stage, upstream of the intermediate pressure exhaust; and diverting the steam path from the first steam path to said second steam path in response to a control signal operating a valve control system disposed within said first and second steam paths.

11. A method as claimed in claim 10, said diverting step involves operating said valve control system so that a first control valve disposed within said first steam path closes and a second control valve disposed within said second steam path opens.

12. A method as claimed in claim 11, wherein operating said valve control system further involves utilizing a control means for closing said first control valve and opening said second control valve when the process extraction system extracts steam from the exhaust of the high pressure section.

13. A method as claimed in claim 12, wherein said control means determines when the process extraction system extracts steam from the exhaust of the high pressure section by sensing if a process extraction system control valve is opened.

14. A method as claimed in claim 12, wherein said control means determines when the process extraction system extracts steam from the exhaust of the high pressure section by determining that the steam pressure ratio at the inlet and exhaust of the high pressure section exceeds a predetermined number.

15. A steam turbine system as claimed in claim 10, said diverting step involves operating said valve control system so that a diversion control valve disposed within said first and second steam paths closes said first path and opens said second path.

16. A method as claimed in claim 15, wherein operating said valve control system further involves utilizing control means for operating said diversion control valve so as to close said first steam path and open said second steam path when the process extraction system extracts steam from the exhaust of the high pressure section.

17. A method as claimed in claim 16, wherein said control means determines when the process extraction system extracts steam from the exhaust of the high pressure section by sensing if a process extraction system control valve is opened.

18. A method as claimed in claim 16, wherein said control means determines when the process extraction system extracts steam from the exhaust of the high pressure section by determining that the steam pressure ratio at the inlet and exhaust of the high pressure section exceeds a predetermined number.

* * * * *